US005820521A

United States Patent [19]

Edwards et al.

[11] Patent Number: 5,820,521

[45] Date of Patent: Oct. 13, 1998

[54] HAND HELD EXERCISER

[75] Inventors: Alan L. Edwards, Yorba Linda; Juan F. Diaz, Brea, both of Calif.

[73] Assignee: AGI Products, Inc., Anaheim, Calif.

[21] Appl. No.: 684,307

[22] Filed: Jul. 17, 1996

Related U.S. Application Data

[63] Continuation of Ser. No. 417,685, Apr. 6, 1995, abandoned.

[51] Int. Cl.[6] ..... A63B 23/14; A63B 21/015

[52] U.S. Cl. ..... 482/44; 482/46

[58] Field of Search ..... 482/44, 45, 46, 482/114, 118, 115, 117, 116

[56] References Cited

U.S. PATENT DOCUMENTS

| | | | |
|---|---|---|---|
| 3,211,453 | 10/1965 | Williams | 482/46 |
| 4,203,591 | 5/1980 | Gibson | 482/46 |
| 4,557,479 | 12/1985 | Guibert | 482/44 |
| 5,167,596 | 12/1992 | Ferber | 482/46 |
| 5,445,581 | 8/1995 | Ferber | 482/46 |

*Primary Examiner*—Stephen R. Crow

*Attorney, Agent, or Firm*—G. Donald Weber, Jr.

[57] ABSTRACT

A portable, articulated, hand-held exercising device comprising a pair of elongated tubular handles pivotally joined to each other by a common connector assembly. Each handle has an axis of rotation substantially normal to the other handle. Each handle has an independently adjustable torque/force characteristic. Thus, each handle may be rotated about its longitudinal axis with adjustable torque adjustment characteristics. The exerciser serves, in general, to condition the wrist, arms, chest, torso and shoulders of the user.

13 Claims, 3 Drawing Sheets

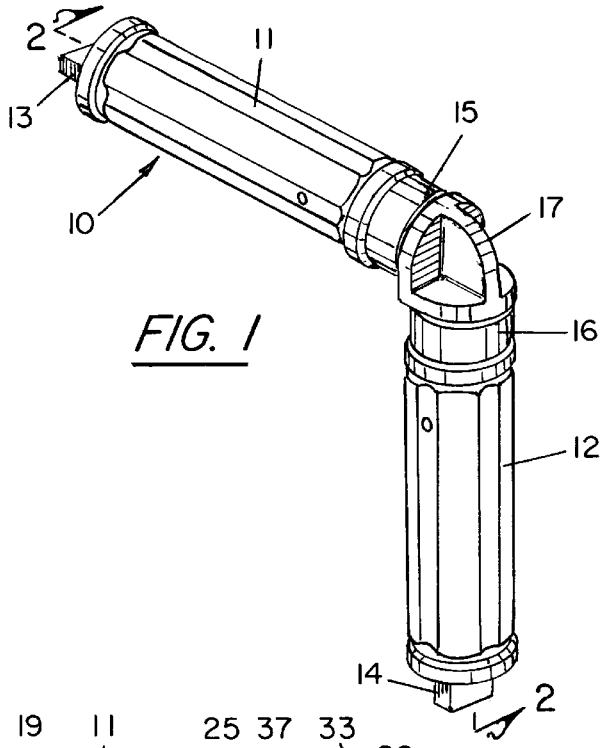
FIG. 1
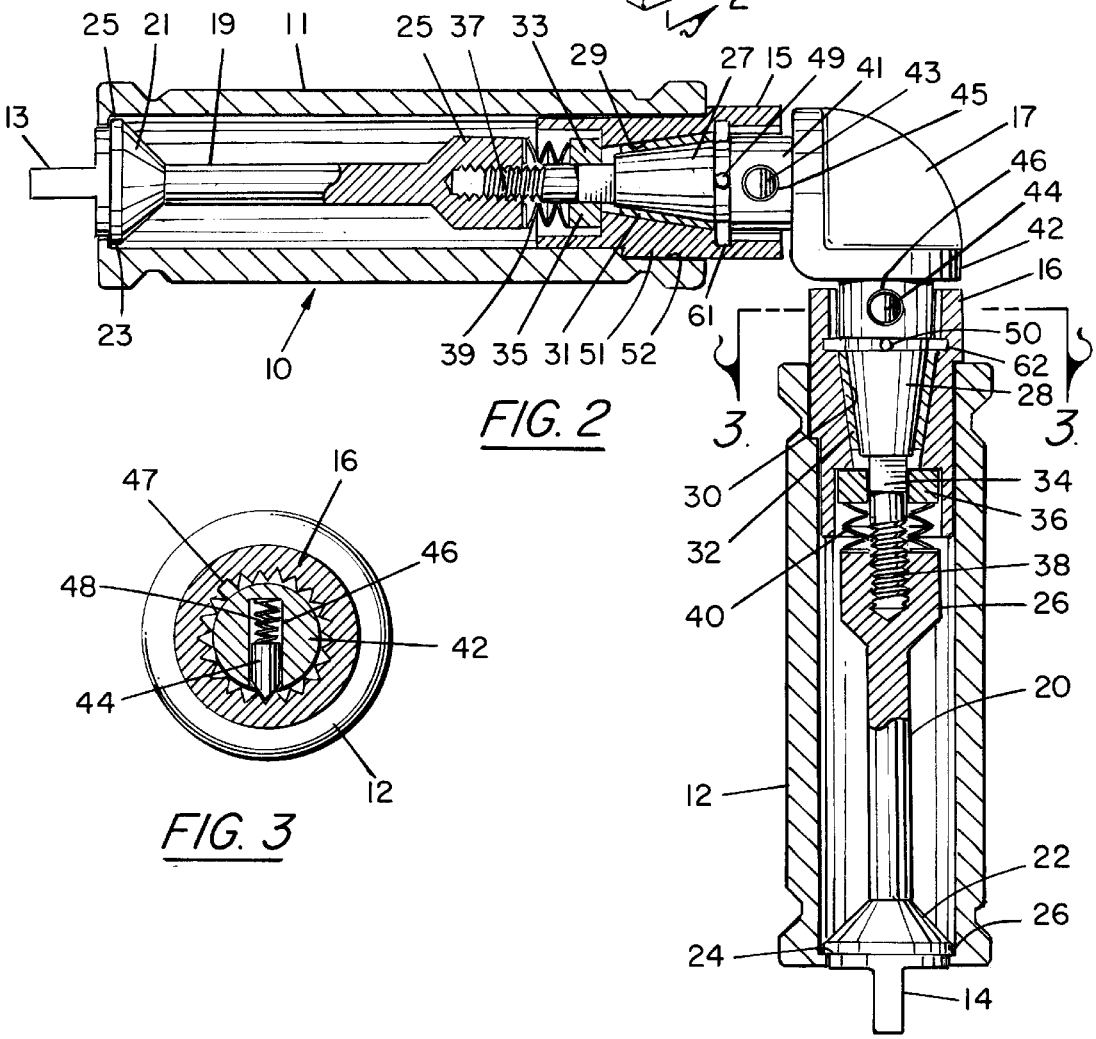
FIG. 2
FIG. 3

HAND HELD EXERCISER

This is a continuation of application Ser. No. 08/417,685, filed Apr. 6, 1995, now abandoned.

BACKGROUND

1. Field of the Invention

The invention relates, generally, to a manual exercising device suitable for fitness, athletic, therapeutic and general exercising purposes and, more particularly, to an articulated exerciser which when held in the hands of a user is capable of being manipulated to undergo both simple and complex motions in order to develop the user's muscular system.

2. Prior Art

There are many exercising devices known in the art. These devices include gripping devices which are squeezed by hand to develop certain muscle tone. There are clubs or bats which are swung to enhance muscle memory or the like. There are special weights for selective attachment to the equipment (e.g. golf clubs, baseball bats) or to parts of the human body to improve muscle condition or function. There are body building or muscle toning machines or gym accessories. There are devices which are twisted to enhance musculature of the body. However, it is always desirable to provide a compact, self-contained, relatively inexpensive exercising device which can be enjoyed by the consuming public.

The Ferber patent cited infra describes a 3-piece exerciser of similar design. However, this device is more expensive and more complicated than the instant invention.

PRIOR ART STATEMENT

The best known prior art is U.S. Pat. No. 5,167,596; HAND HELD EXERCISER, D. Ferber. This patent is directed to a hand held exercising device having a plurality of interconnected components.

SUMMARY OF THE INVENTION

The invention provides an improved hand-held exerciser which comprises a pair of handles each of which is joined to a connector assembly so that the handles are disposed at an angle of approximately 90°. The exerciser is constructed to permit each handle to rotate about the longitudinal axis thereof, individually or in concert with the other handle. The exerciser includes adjustment means for providing an independently adjustable torque/force in each handle. The adjustment means includes a tension bar and friction disks.

It is, accordingly, an object of the present invention to provide a small, readily portable, hand-held, exercising device which is simple to operate.

BRIEF DESCRIPTION OF THE DRAWINGS

FIG. 1 is a perspective view of a preferred embodiment of the exercising device of the instant invention.

FIG. 2 is a partially broken away, partially cross-sectional view of the exercising device of the instant invention.

FIG. 3 is a cross-sectional view taken along the line 3—3 of FIG. 2.

DETAILED DESCRIPTION OF A PREFERRED EMBODIMENT

Figure 4:
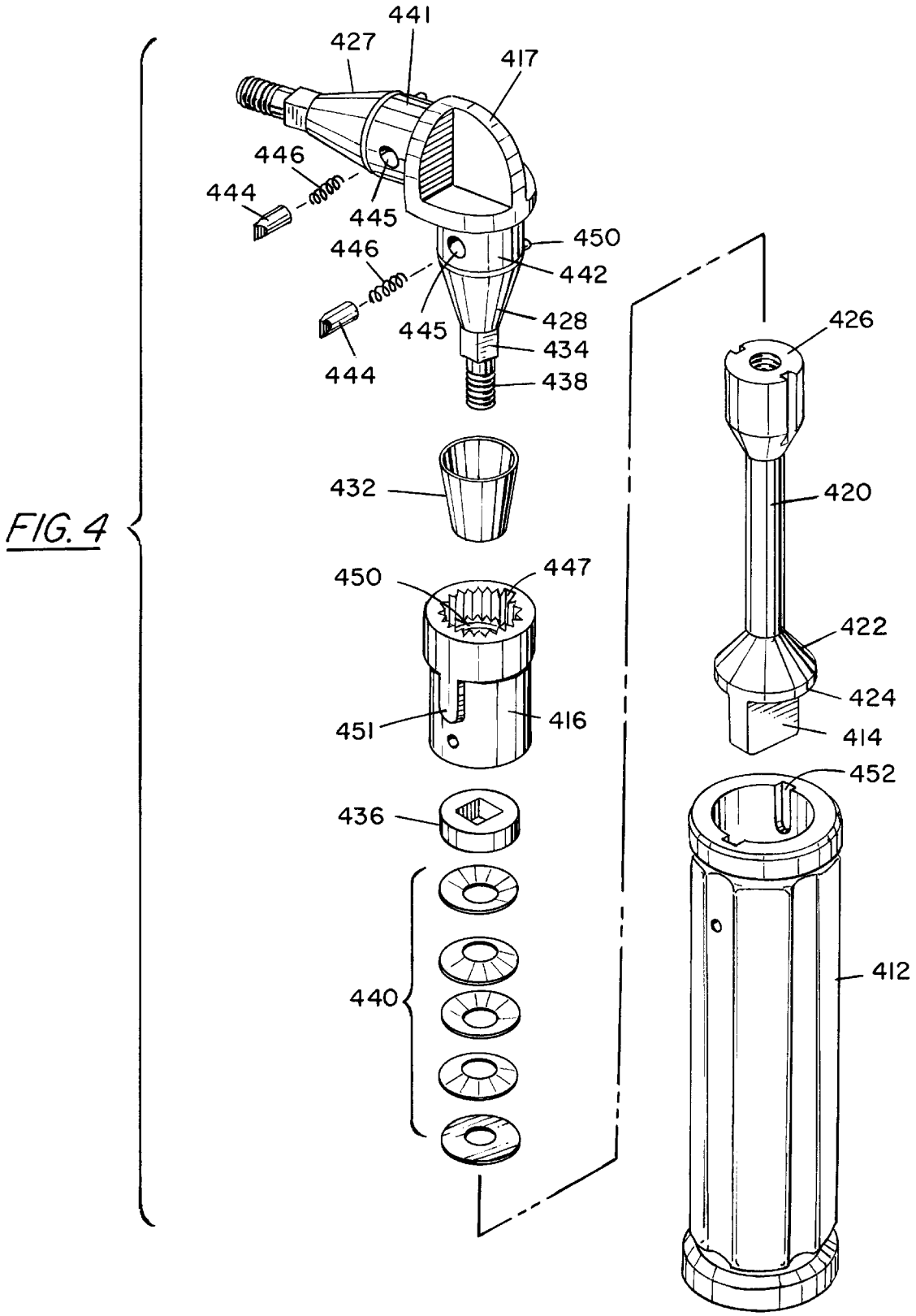
FIG. 4 is an exploded view of one of the handles of the exerciser of FIG. 1.

Referring now to FIG. 1, there is shown a perspective view of the exerciser 10 of the instant invention. As shown in FIG. 1, the exerciser 10 comprises elongated, tubular handles 11 and 12 and an intermediate connector assembly 17. The connector assembly 17 is rotatably joined to one end of each of the handles 11 and 12. The handles 11 and 12 are rotatable about the respective longitudinal axes thereof which axes are defined by tension adjustment shafts (see infra). The shafts extend axially through the handles 11 and 12 and are connected to the connector assembly 17. The adjustment shafts are connected to the tabs 13 and 14 which extend outwardly from the tubular handles 11 and 12.

The ratchet collars 15 and 16 are engaged by the handles 11 and 12, respectively. The collars rotate around the adjustment shafts along with the handles. The ratchet mechanism is shown and described in detail infra.

Also, as will be described infra, a torque/force adjustment mechanism operated and controlled by the tabs 13 and 14 is mounted within the respective handle 11 or 12. This adjustment mechanism selectively renders the rotation of the handle, relative to the adjustment shaft, more or less difficult, as desired.

Referring now to FIG. 2, there is shown a partially broken away, partially cross-sectional view of the exerciser 10. The handles 11 and 12 are shown as generally tubular components. The handles 11 and 12 are fabricated of a suitable plastic, for example. The adjustment shafts 19 and 20 extend axially through the handles 11 and 12, respectively. Typically, the shafts (also referred to as tension rods) are made of a suitable plastic.

Enlarged retainers 21 and 22 are formed adjacent the outer ends of shafts 19 and 20, respectively. These retainers are shown having a conical shape. Of course, virtually any suitable configuration is possible. The outer surfaces 23 and 24, respectively, of the retainers 21 and 22 are configured to abut against the inner shoulders 25 and 26, respectively, of the handles 11 and 12. This arrangement retains (or confines) the shafts 19 and 20 within the respective handles to prevent the shafts (or related items) from being discharged out of the handles, especially during a torque/friction adjustment procedure.

The tabs 13 and 14 are integrally formed at the ends of the retainers 21 and 22 of shafts 19 and 20, respectively. The tabs 13 and 14 extend outwardly through the open ends of the handles 11 and 12, respectively. The tabs are readily gripped by the user of the exercising device 10 to turn the respective adjustment shaft to alter the torque/force characteristics, as noted hereinafter.

The inner ends of shafts 19 and 20 comprise sockets 25 and 26 which are internally threaded. The sockets threadedly engage the threaded ends 37 and 38, respectively, of connector assembly 17.

As shown in FIG. 2, the connector assembly 17 includes cones 27 and 28 which are joined together at about a 90° angle. The connector assembly is, typically, formed of a suitable plastic. The cones 27 and 28 extend into cone sockets 29 and 30, respectively, of the ratchet collars 15 and 16. The ratchet collars are formed of a suitable plastic. The ratchet collars include a key 51 portion formed at the outer surface thereof which extends into the slot or keyway 52 in the inner surface of the tubular handles.

A key 51/keyway 52 arrangement is provided so that the ratchet collars 15 and 16 interlock with the respective handles 11 and 12. Thus, the ratchet collars 15 and 16 do not rotate relative to the respective handles 11 or 12. A portion of the ratchet collar extends outside of the end of the handle between the handle and the connector assembly 171.

Floating cone bushings 31 and 32, typically made of nylon, are interposed between the cones and the cone sockets to ensure proper seating of the conical components. In addition, the cone bushings provide a somewhat slidable surface between the cones and the cone socket.

Each of the threaded ends of the cones 27 and 28 of connector assembly 17 includes a shaft portion which extends beyond the cones. The shafts have rectangular sections 33 and 34, respectively, which extend through anti-rotation washers 35 and 36. The threaded ends 37 and 38 of the shafts extend through the anti-rotation washers 35 and 36 as well as a number of resilient washers. The resilient washers are cup-shaped and placed in alternating opposite position to form springs 39 and 40, referred to as Belleville disc springs. The Belleville disc springs 37 and 38 are disposed between the ends 25 and 26 of shafts 19 and 20 and the anti-rotation washers 35 and 36, respectively.

The threaded ends 37 and 38 of the connector assembly extend through the disc springs into the threaded sockets 25 and 26 at the ends of shafts 19 and 20, respectively. The sockets are threaded onto the shaft ends 37 and 38 by turning the tabs 13 and/or 14. As the tabs are turned, the cones 27 and 28 are drawn into (or expelled from) the cone sockets 29 and 30. Thus, the outer surface of the cones 27 and 28 engage the mating conical bushing at the inner surface of the sockets 25 and 26 in a variable frictional engagement.

As the sockets 25 and 26 are tightened on the threaded ends 37 and 38 of the shafts on the cones, the washers 128 are compressed. Compression of the washers causes an increased frictional resistance between the conical members 27 and 28 and the inner surface of sockets 29 and 30. This frictional resistance may be adjusted by tightening or loosening the socket nut 26 relative to the threaded end of the pertinent shaft at the ends of the cones. This adjustment is achieved by turning tabs 13 and 14 which are part of the shafts 19 and 20 which includes the sockets 25 and 26.

When a handle 11 or 12 is rotated about the longitudinal axis thereof, the related ratchet collar 15 or 16 is caused to rotate therewith relative to the pertinent cone 27 or 28. The cone bushing 31 or 32 facilitates such rotation because of the smooth surfaces thereof between the respective cone and with the cone socket. However, the frictional force between the several components is controlled by turning the tab thereby adjusting (i.e.) compressing or releasing the Belleville dish springs.

In a preferred embodiment, ratchet retainer cylinders 41 and 42 are provided at the inward ends of cones 27 and 28, respectively. These cylinders (as well as the cones) are formed as part of the assembly 17. An aperture 43 or 44 is formed in the respective cylinder 41 or 42. Each aperture is in the form of a blind cavity which extends part way through the cylinder.

Pawls 43 and 44 are formed as short cylinders with a flat inner end and a spade shaped outer end (see FIG. 3). The pawls are free to slide within the respective cavities.

At a suitable location, for example at the base of ratchet cylinders 41 and 42 there are provided locking pins 49 and 50. These pins extend outwardly from the peripheral surface of the respective cones.

A pin receiving groove 61 or 62 is formed in each of the ratchet collars 15 or 16, preferrably below the teeth in the serrated inner surface (see FIG. 3). The pins 49 and 50 are designed to fit into the grooves 61 and 62, respectively, to lock the ratchet collar to the related cone.

Referring now to FIG. 3, there is shown a cross-sectional view of the handle taken along the lines 3—3 in FIG. 2. In FIG. 3, the pawl 44 is mounted within the cavity 42. A coil spring 46 is captured within the cavity 42 by pawl 44. Thus, pawl 44 is spring-loaded outwardly relative to cylinder 42. The ratchet collar 16 is disposed adjacent to handle 12 and surrounding cylinder 42.

In this embodiment, the inner surface of ratchet collar 16 is serrated or toothed. This surface is adapted to interact with the spring-loaded pawl 44 to produce an audible "clicking" noise when the handle is turned relative to the connector assembly. That is, the spring loaded pawl 44 is pushed into the cavity 42 by a point on the toothed surface and clicks when driven outwardly by spring 48 as the ratchet collar is rotated along with handle 11 or 12. The vertical gap 47 is formed in the inner surface of the ratchet collar 16. This gap is adapted to permit locking pin 49 to slide into the groove 50.

Referring now to FIG. 4, there is shown an exploded view of one handle of the assembly 10. For purposes of discussion, components in FIG. 4 which are similar to components in prior Figures include the same last two digits.

For example, in FIG. 4, the handle 412 is similar to the handle 12 The handle 412 is shown as a generally tubular component. The adjustment shaft 420 is intended to be mounted axially in the handle 412.

Retainer 422 is formed adjacent the outer end of shaft 420 and has a conical shape in this embodiment. The surface 424 of the retainer 422 is configured to abut against the inner shoulder of the handle 412. The tab 414 is formed at the end of the retainer 422 of shaft 420.

The inner end of shaft 420 includes a socket 426, the cavity of which is internally threaded. The socket 426 is adapted to threadedly engage the threaded end 438 of connector assembly 417.

The connector assembly 417 includes cone 428. In this embodiment, cone 428 extends into cone socket 430 of the ratchet collar 416. Floating cone bushing 432 is interposed between cone 428 and cone socket 430 to ensure, inter alia, proper seating of the components. In addition, cone 428 includes a rectilinear (or the like) section 434, which extends through anti-rotation washer 436.

The threaded end 438 of the shaft also extends through a number of resilient washers arranged in alternating opposite position to form a Belleville disc spring 440. The threaded end 438 of the connector assembly further extends into the socket 426. As the socket 426 is tightened onto the threaded end 438 of the shaft on the cone, the washers 440 are compressed. Compression of the washers causes an increased frictional resistance between the conical member 428 and the inner surface of socket 430. The frictional resistance may be adjusted by tightening or loosening the socket 426 relative to the cone by turning tab 414.

Ratchet cylinder 442 is provided at the inward end of cone 428 as part of the assembly 417. Apertures 443 and 445 are formed in the respective cones 427 or 428. The apertures are blind cavities which extend part way through the cylinders.

Pawls 443 and 444 are formed as short cylinders with a flat inner end and a spade-shaped outer end. The pawls are free to slide within the respective cavities.

Coil springs 446 are captured within the cavities by pawls so that the pawls are spring-loaded outwardly relative to the cylinders.

The inner surface of ratchet collar 416 is serrated or toothed. This surface is adapted to interact with the spring-loaded pawl 444 to produce an audible "clicking" noise when the handle 412 is turned relative to the connector assembly 417. That is, the spring-loaded pawl is pushed into the cavity by a point on the toothed edge and clicks when driven outwardly by spring 446. A vertical gap 447 is formed in the inner surface of the ratchet collar 416. This gap is adapted to permit pin 450 on the outer surface of ratchet cylinder 542 to slide into the groove 459 in the upper surface of collar 416. This arrangement secures ratchet cylinder 416 to the connector 417.

The outer surface of collar 416 includes a key 451 which extends outwardly therefrom. The key 451 selectively engages keyway slot 452 in the inner surface of handle 412.

Figure 5:
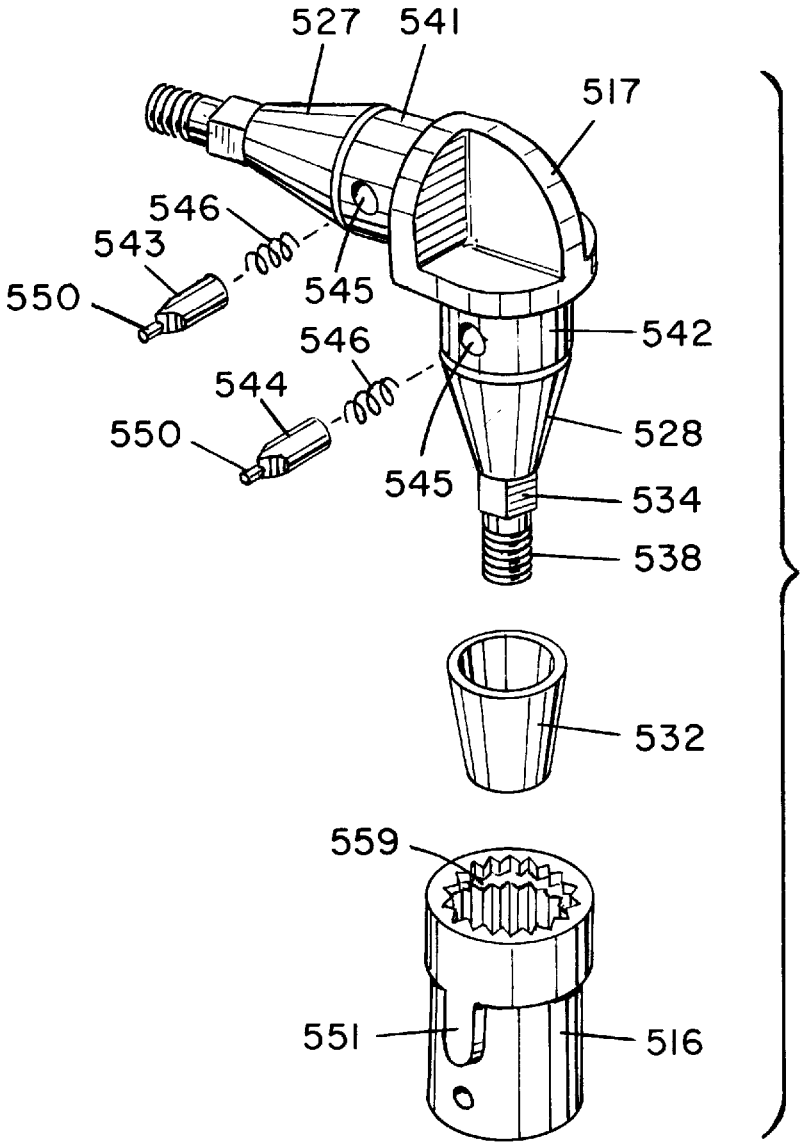
FIG. 5 is a modified version of the invention.

Referring now to FIG. 5, there is shown an exploded view of a modification of the handles of the assembly 10. For purposes of discussion, components in FIG. 5 which are similar to components in prior Figures include the same last two digits.

For example, in FIG. 5, the connector assembly 517 includes cone 528, which extends into cone socket 530 of the ratchet collar 516. The floating cone bushing is omitted for convenience. The threaded end 538 of the shaft functions in the same manner as threaded end 438 in FIG. 4.

Ratchet cylinders 541 and 542 are provided at the inward end of cones 527 and 528, respectively, as part of the assembly 517. Apertures 543 and 545 are formed in the respective cylinders 541 and 542. The apertures are blind cavities which extend part way through the cylinders.

Pawls 543 and 544 are formed as short cylinders with a flat inner end. In this embodiment, the pawls have a spade-shaped outer end with a short pin 550 extending therefrom. The pin 450 on pawl 544 is adapted to extend into the groove 559 adjacent the upper edge of collar 516. The pawls are free to slide within the respective cavities.

Coil springs 546 are captured within the cavities by pawls so that the pawls are spring-loaded outwardly relative to the cylinders.

The inner surface of ratchet collar 516 is serrated or toothed. This surface is adapted to interact with the spring-loaded pawl 544 to produce an audible "clicking" noise when the handle 412 (see FIG. 4) is turned relative to the connector assembly 517. That is, the spring-loaded pawl is pushed into the cavity by a point on the toothed edge and clicks when driven outwardly by spring 546.

The outer surface of collar 516 includes a key 551 which extends outwardly therefrom. The key 551 selectively engages keyway slot 552 in the inner surface of handle 412 as described supra.

The invention provides, therefore, a simple hand-held exerciser which has adjustable torque characteristics, and which permits the user to turn a pair of handles around three distinct axes to perform any desired set of exercises.

It will be appreciated that while particular embodiments of the invention have been shown and described, modifications may be made. It is intended in the claims to cover all modifications which come within the true spirit and scope of the invention.

We claim:

1. An articulated exerciser comprising;

a pair of elongated tubular housings, a pair of tension rods, each tension rod axially mounted within a respective one of said tubular housings and extending longitudinally therethrough, common connector means threadedly connected to each of said tension rods whereby said tension rods are disposed at a fixed angle to each other, said common connector means includes a pair of conical ends extending outwardly therefrom, the axes of which are arranged perpendicular to each other, said tubular housings mounted on said tension rods and disposed at said fixed angle to each other; and friction means coupled to at least one of said tubular housings;

said friction means mounted intermediate said common connector means and at least one of said tension rods, said friction means includes a friction socket with an internal conical surface for receiving said conical end of said common connector means, and a conical bushing interposed between said conical end of said common connector means and said internal conical surface of said friction socket, said friction means adapted to be adjusted by threadedly moving said tension rod relative to said common connector means;

spring means coaxially mounted on said connector means;

said connector means threaded to and engaging said tension rod for selectively biasing said spring means in the direction of the friction members to cause said friction member to exert a friction force between said connector means and said tension rod, means coupling one said elongated tubular housing to said tension rod;

and means coupling said elongated tubular housing to said common connector means so that rotation of said elongated tubular housing is variably affected by said friction means against the friction force therebetween.

2. The exerciser recited in claim 1 wherein, said friction means includes a plurality of friction discs coaxially mounted on said common connector means adjacent to said tension rod.

3. The exerciser defined in claim 1 wherein, at least one of said tubular housings is rotatable about the longitudinal axis thereof.

4. The exerciser defined in claim 1 including, at least one annular ratchet member coupled to at least one said elongated tubular housing, and a pawl member supported by said common connector means for engaging said ratchet member to produce a clicking noise as the elongated tubular housing is rotated about the longitudinal axis thereof.

5. The exerciser recited in claim 4 wherein, said ratchet member is integral with said friction means.

6. The exerciser recited in claim 4 including, resilient means mounted in said common connector means to urge said pawl member into engagement with said ratchet member.

7. The exerciser recited in claim 1 wherein, said common connector includes pin means which extends outwardly therefrom, and said friction means includes a groove therein which engages said pin means.

8. The exerciser recited in claim 4 wherein, said ratchet member includes a groove therein, and said pawl member includes a pin at the outer end thereof which is engaged by said groove.

9. The exerciser recited in claim 1 wherein, said common connector means includes a pair of conical surfaces which are aligned perpendicular to each other.

10. The exerciser recited in claim 1 wherein, each said friction means is coupled to the respective elongated tubular housing by a complementary key and keyway combination.

11. The exerciser recited in claim 1 wherein, each tension rod includes an enlarged end portion, and each tubular housing includes an internal shoulder at one end to engage said enlarged end portion.

12. The exerciser recited in claim 11 including, tab means extending from said enlarged end portion of said tension rod and protruding beyond said internal shoulder at said one end of said tubular housing.

13. The exerciser recited in claim 2 wherein, said tension rod includes threaded socket means for connection to said common connector means, said plurality of friction discs resting upon said threaded socket means.

* * * * *